US005765985A

United States Patent [19]

Johnson et al.

[11] Patent Number: 5,765,985

[45] Date of Patent: Jun. 16, 1998

[54] REFUSE COLLECTION VEHICLE CYLINDER RESTRAINING APPARATUS

[75] Inventors: Gary Lee Johnson, Fort Payne, Ala.; Norman John Glomski, Chattanooga, Tenn.; Ernest Dwight McCullough, Gaylesville, Ala.

[73] Assignee: The Heil Company, Chattanooga, Tenn.

[21] Appl. No.: 611,369

[22] Filed: Mar. 6, 1996

[51] Int. Cl.[6] ..... B65F 3/20

[52] U.S. Cl. ..... 414/511; 414/517; 414/525.6

[58] Field of Search ..... 414/510–513, 414/516–517, 525.2, 525.6; 403/2; 280/457; 212/238, 261

[56] References Cited

U.S. PATENT DOCUMENTS

| | | | |
|---|---|---|---|
| 3,252,602 | 5/1966 | Bowles | 414/511 |
| 3,724,875 | 4/1973 | Hillman | 280/457 |
| 3,912,405 | 10/1975 | Katt | 403/2 |
| 4,544,320 | 10/1985 | Haines | 414/511 |
| 4,627,783 | 12/1986 | De Filippi | 414/511 X |
| 4,877,366 | 10/1989 | De Filippi | 414/511 X |
| 5,484,217 | 1/1996 | Carroll et al. | 403/2 |

FOREIGN PATENT DOCUMENTS

| | | | |
|---|---|---|---|
| 1251956 | 11/1971 | United Kingdom | 280/457 |
| 2030534 | 4/1980 | United Kingdom | 280/457 |

*Primary Examiner*—James W. Keenan
*Attorney, Agent, or Firm*—Alan Ruderman

[57] ABSTRACT

A front loading refuse collection vehicle has a refuse receiving body within which a compaction panel is movable between a refuse receiving position and refuse compacting positions spaced from the receiving position. A pair of hydraulically actuated power cylinder assemblies are connected to the body adjacent the refuse receiving end and to the compaction panel, the assemblies extending in criss-cross fashion one above the other. The ends of the assemblies connected to the panel are restrained by apparatus which is normally passive and does not interfere with the connection between each hydraulic cylinder assembly and the panel, but which upon failure of the connection between a hydraulic cylinder assembly and the panel restrains movement of the cylinder assembly having the failed connection so that the end of that assembly remains closely adjacent to the panel and between the side walls of the body. The restraining apparatus thus acts as a safety device to prevent the end of a cylinder assembly having a failed connection from exiting the body.

21 Claims, 3 Drawing Sheets

REFUSE COLLECTION VEHICLE CYLINDER RESTRAINING APPARATUS

BACKGROUND OF THE INVENTION

This invention relates to refuse collecting vehicles of the type having a compaction panel for compacting the refuse against a rear door and for discharging the refuse after the rear door has been opened, and more particularly to apparatus for preventing the end of a power driver which move the panel from haphazardly swinging about in the event of a failure at the connection between the power driver and the compaction panel.

Refuse collection vehicles are known which have a compactor located within the refuse receiving and carrying body or shell of the vehicle. In a front loading refuse collecting vehicle the compactor comprises a panel or platen transversely extending across the sides of the body and movable along tracks lengthwise through the body. Refuse is received through a hopper into the body at the top and rearwardly of the compaction panel. The panel is thereafter forcibly moved rearwardly to compact the refuse against a rear door. The refuse is discharged from these front loading vehicles through the rear door, the door being pivotably connected to the body at the top so that it may be pivoted upwardly. In certain of these vehicles the refuse is discharged through the open rear door by tilting the body relative to the chassis of the vehicle. In others of these front loading vehicles all of the refuse is discharged by the compaction panel which acts to eject the refuse when the rear door is open.

The force applying means for moving the compaction panel conventionally comprises hydraulic cylinders acting between the compaction panel and the frame at the front of the refuse vehicle body. In at least those vehicles where the compaction panel also acts as an ejector, the cylinders generally have telescopic multiple stages. Whether single stage or multi-stage there is normally one assembly at each side of the compaction panel so that the panel may have substantially equal forces at each side for balanced and smooth movement. The hydraulic fluid lines conventionally connect to and feed the cylinder assembly at the end which is connected to the frame. The other end which may be defined as the panel end, whether it is the end having the smaller or the larger diameter cylinders in the multi-stage telescopic cylinder construction, or whether it is the cylinder or the rod in the single stage cylinder construction, is connected to the compaction panel. This latter connection conventionally is by means of a pivot or journal pin.

A difficulty which is known to occur in the event of a failure in the connection at the panel end, such as a shearing of the journal pin, is that the cylinder may swing uncontrollably if the operator has not discovered the failure and hydraulic fluid continues to be pumped to the cylinders. The panel end of the cylinder assembly which is now free to swing about the journal connection with the frame at the other end of the cylinder assembly is known to have broken through and extended out a side wall of the body or shell of a vehicle resulting in a hazard to passing vehicles and other structures. Additionally, since such a failure results in only one cylinder assembly acting on the panel, the forces on the panel are no longer equal at the opposite sides and the panel may become off-set and lockup on the tracks. If this occurs, substantial structural damage may occur.

SUMMARY OF THE INVENTION

Consequently, it is a primary object of the present invention to provide apparatus which precludes unrestrained movement of the compaction panel end of a cylinder assembly normally connected between the compaction panel and the front of the frame of the body of a front loading refuse collection vehicle so that should the cylinder assembly become disconnected from the compaction panel, the free end will not present a safety hazard.

It is another object of the present invention to provide apparatus which may restrain the end of a cylinder assembly connected to the compaction panel in the body of a front loading refuse collecting vehicle should the connection fail, the apparatus retaining the free end of the assembly within the body.

It is a further object of the present invention to provide a redundant connection to a cylinder pivotably connected to a compaction panel in the body of a front loading refuse collecting vehicle, the redundant connection being passive unless the pivotable connection fails, the redundant connection thereafter acting to restrain the end of the cylinder from freely moving outside the lateral confines of the compaction panel.

Accordingly, the present invention provides a refuse collection vehicle having a compaction panel for compacting refuse deposited into the refuse carrying body of the vehicle between the panel and the discharge end of the body, the panel being driven between a refuse receiving position and compaction positions by hydraulically actuated power cylinders connected at first ends to the body and at second ends to the compaction panel, and the cylinders adjacent the second ends being connected to restraining means which restricts movement of the second ends to within the confines of the body in the event of a failure in the connection between the second ends and the compaction panel. The restraining means thus effectively provides a redundant connection for the cylinders adjacent the second ends of the compaction panel to prevent a second end from potentially breaking through the body of the vehicle should a failure occur in the connection between a cylinder and the panel.

The restraining means is anchored to the compaction panel remote from the connection to the cylinders so that the restraining means will limit movement of the second ends of the cylinders to a short distance from the panel should the failure occur. Additionally, this movement preferably is limited by the restraining means so that the second ends of the cylinders will act against the compaction panel even after such failure. Since the compaction panel is propelled along the tracks lengthwise of the body and since there is one power cylinder assembly acting on the compaction panel at each side thereof, should a failure of the connection at the second end occur, limiting the movement of the second end so that it may act against the compaction panel assures that if the cylinders are extended to push the panel in the direction of compaction, the panel will not have excessively unbalanced or off-set forces acting on it to lock up the panel and cause possible structural damage. When the cylinders are retracted the restraining means assures that the panel will follow.

In carrying out the invention, the restraining means preferably includes a cable in the form of a wire rope acting between a cylinder adjacent the second end and the compaction panel at the location where the cable is anchored. In one embodiment one end of the cable is journally connected to the cylinder and the other end of the panel, whereas in a second embodiment each end of the cable is journalled to a respective one of the two cylinders and is restrained by anchors on the panel between the ends of the cable. The length of the cable, the locations of attachment to the cylinders and the location where the cables are anchored to the panel determines the maximum amount of movement of a disconnected end of a cylinder, and thus the second end may be confined as aforesaid in the event of a failure at a second end of the cylinder assembly.

BRIEF DESCRIPTION OF THE DRAWINGS

The particular features and advantages of the invention as well as other objects will become apparent from the following description taken in connection with the accompanying drawings in which.

DESCRIPTION OF THE PREFERRED EMBODIMENTS

Figure 1:
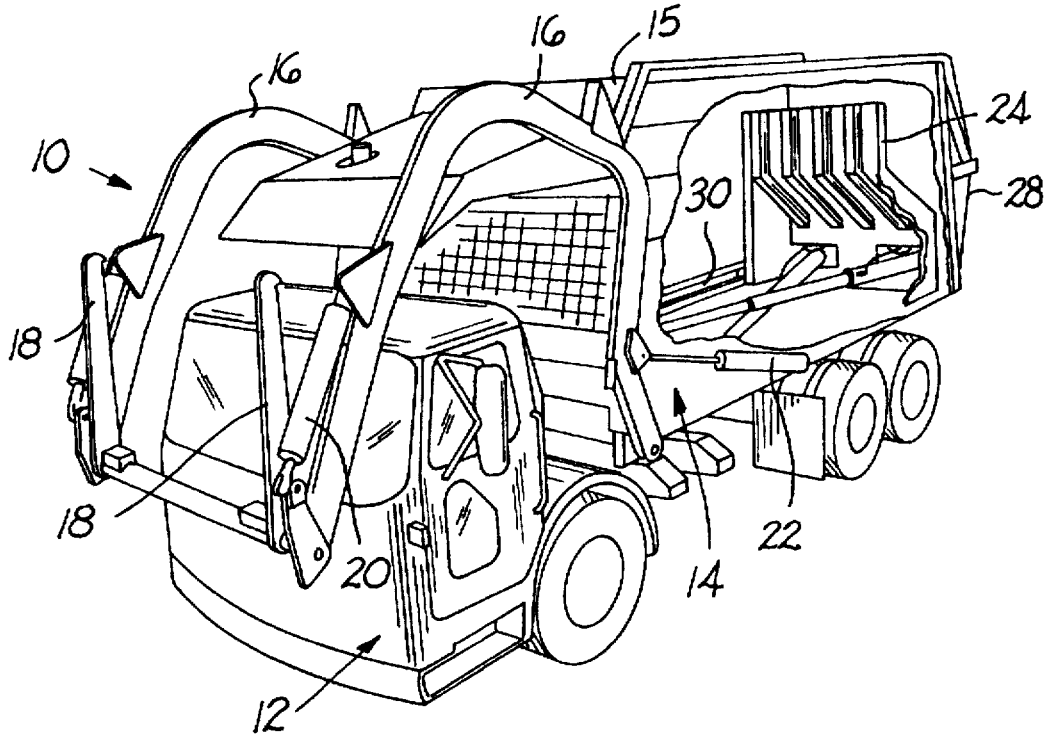
FIG. 1 is a perspective view of a refuse vehicle with portions thereof broken away to show the interior of the body.

Referring now to the drawings, a refuse collection vehicle 10 is illustrated in FIG. 1, the vehicle including a cab 12 mounted at the front of the chassis of the vehicle and the refuse receiving and storage body or shell 14 mounted behind the cab. The vehicle 10 is a front loading refuse collecting vehicle and the body just behind the cab is open at the top forming a hopper 15 for receiving refuse which is dumped into the body through the opening by means of refuse container lifting arms 16. The arms 16, which have a substantially U-shaped configuration, carry container grasping fingers 18 at the extremities of a pair of limbs and may be actuated from the position illustrated in FIG. 1 to an extended position by hydraulic cylinders 20 to grasp a refuse container. The arms may thereafter be pivoted upwardly and rearwardly about pivot points at the extremities of the other limbs by other hydraulic cylinders 22 acting between the latter limbs of the arms and a structural member at the exterior of the body, as is well known in the art.

Located within the interior of the body 14 is a compaction panel 24 which is movable from a retracted position adjacent to the cab forwardly of the refuse receiving hopper opening 15 in the top of the body, and an extended rearward position. The compaction panel 24 has a rearwardly facing surface 26, which may be stepped from an upper vertical surface through an inclined surface to a lower vertical surface, for acting against the refuse deposited into the body to compact the refuse against a rear door 28 and for expelling the refuse when the door is opened by pivoting upwardly. A track 30, 32 extends longitudinally along each respective sidewall 34, 36 of the body 14 for receiving a respective rail 38, 40 welded to the sides of the compaction panel 24 to guide the panel between the extended and retracted positions.

Figure 2:
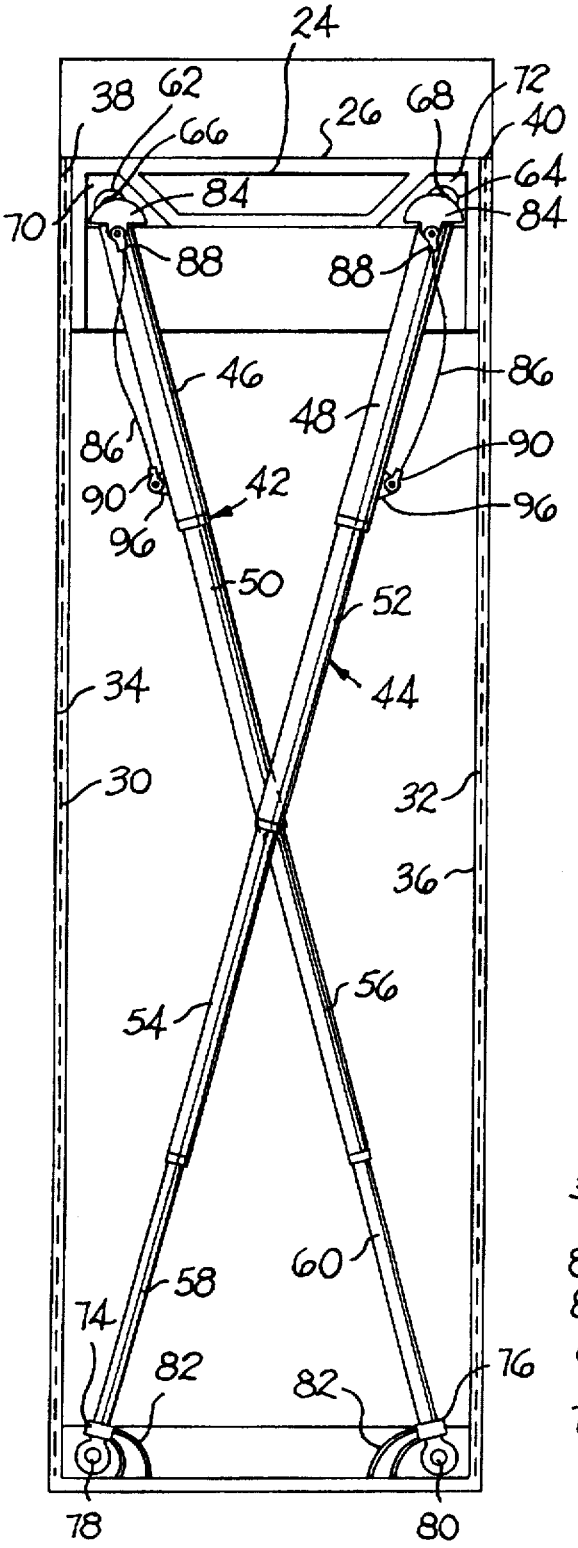
FIG. 2 is a top plan view taken within the body of the vehicle illustrated in FIG. 1 with the compaction panel propulsion cylinder assembly in the fully extended position.
Figure 3:
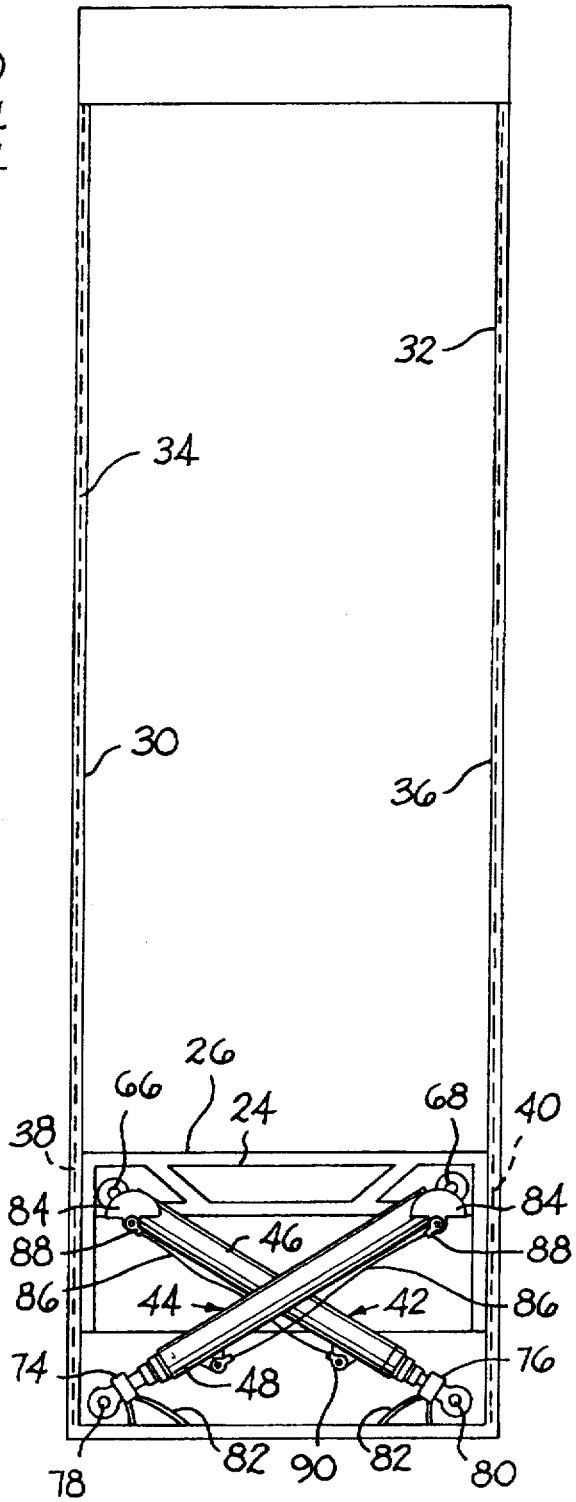
FIG. 3 is a view similar to FIG. 2 but with the cylinder assembly in the fully retracted position.

To provide the driving force for moving the compaction panel, a pair of hydraulic cylinder assemblies 42, 44 are provided. Preferably, so as to provide a large translational movement of the panel between the retracted position forward of the refuse receiving hopper opening and the fully extended position for forcing the refuse out the rear door 28, thereby to permit the body to be elongated greatly for maximizing the amount of refuse received and contained within the body, each of the cylinder assemblies is of a multiple stage telescopic construction. Preferably, the cylinder assemblies are four stage units, each having a respective outer cylinder or barrel 46, 48 which receives a second stage cylinder or barrel 50, 52, the second stage cylinder receiving a third stage cylinder 54, 56, and the latter receiving the fourth stage cylinders or rods 58, 60. The assemblies 42, 44 are arranged in a crossing pattern with one of the assemblies overlaying the other as illustrated in FIGS. 2 and 3 so that the length of each stage may be maximized and yet not extend excessively lengthwise when retracted. This permits the panel 24 to be closely disposed adjacent the front end of the body 14 when the cylinders are in the fully retracted position so that the hopper opening may be close to the front end of the body. The free ends of the first stage or outer cylinders 46, 48 have eyelets 62, 64 for journally receiving pins 66, 68 connected into respective pockets 70, 72 in the panel 24, the pockets being disposed one above the other at each side of the panel. The free ends of the fourth stage or rods 58, 60 are connected to and communicate with small housings 74, 76 which are pivotally mounted about pins 78, 80 on structural frame members at the front of the body 24, the housings 74, 76 being fed with hydraulic fluid through fluid lines 82 from a hydraulic pump (not illustrated) selectively controlled by the operator of the vehicle. These telescopic hydraulic cylinder assemblies are well known in the art and further description thereof is not deemed necessary, suffice it to say that a fluid line or rod extends through the fourth stage to feed fluid to first extend the first cylinder and thereafter the second cylinder and then the third cylinder in succession.

As aforesaid, in vehicles of this type, a safety problem may be encountered in the event a failure in the connection between the cylinder assembly and the compaction panel 24, i.e., between the first stage cylinder 46, 48 and the panel 24. Such a failure may occur for a number of reasons such as a failure of a pivot pin 66, 68. If this occurs, and if the operator of the vehicle does not realize it and permits hydraulic fluid to continue to be pumped to the cylinders as the refuse is compacted and the vehicle is moving down a street, the now free or loose end of the cylinder 46, 48 may uncontrollably swing about the pivot pin 78, 80 at the front of the body. This has been known to result in the loose end breaking through a sidewall 34, 36 to cause major damage outside the body to another vehicle. Also such a failure may result in off-set forces at the opposite sides of the panel 24 resulting in a locking-up of the panel in the tracks 30, 32 with possible structural damage.

Figure 4:
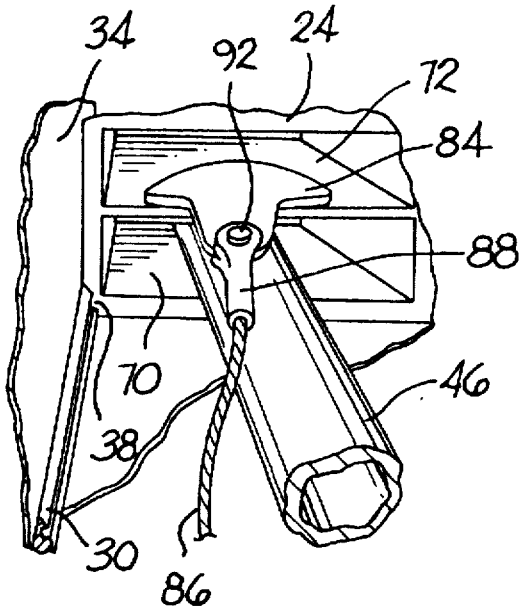
FIG. 4 is a fragmentary perspective view illustrating the connection between the restraining means and the compaction panel.
Figure 5:
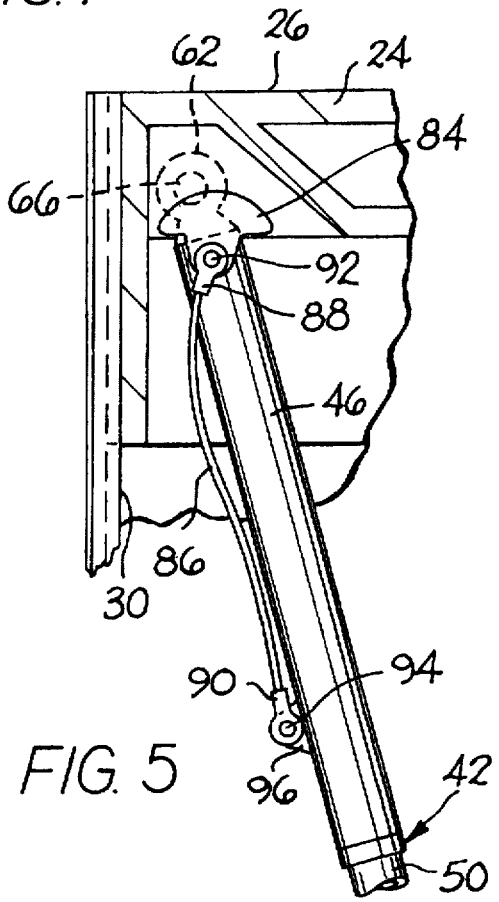
FIG. 5 is a horizontal cross sectional view through a portion of the apparatus in the position illustrated in FIG. 2 greatly enlarged and partly broken away.

In order to correct this problem, the present invention restrains the movement of the cylinders 46, 48 in the event of such failure. It does so by providing a redundant connection that is only operative should the primary connection between the first stage cylinder 46, 48 and the panel 24 fail. Thus, as illustrated in FIGS. 2 through 4, an anchor in the form of a plate 84 is welded to a ledge of a pocket 70, 72 of the panel 24. A restraining member comprising a cable 86 in the form of a high strength metal wire rope or the like having a clevis 88, 90 at each respective end has one clevis, e.g., 88, journally connected by a pin 92 to the plate 84, as best illustrated in FIGS. 4 and 5. The other clevis, e.g., 90, is journally connected by a pin 94 to a lug 96 welded to the outer surface of the respective cylinder 46, 48 at a location which will prevent the end of the cylinder 46, 48 from swinging into abutment with either side wall 34, 36 in the event of a failure at the connection. The lug 96 of one cylinder assembly is offset from the plate 84 of that assembly by 90° so as not to interfere with the other cylinder assembly since, as aforesaid, these assemblies cross one over the other. A failed unconnected free end of the cylinder, which pivots about the respective pin 78, 80 in the event of such failure is constrained by the respective cable which limits the movement. The cable is somewhat flexible when a bending force is applied to it and thus has certain advantages. However, a rigid link may be utilized rather than the cable, but the connection for the link would require a "lost motion" means such as an elongated aperture at one end for receiving one of the journal pins. Of course, other restraining members such as a chain may be used and such other members are contemplated by the invention. The length of the cable between the pins 92, 94 is slightly longer than the direct linear distance between the pins so that there is some slack in the cable which allows the cylinder to extend and retract without limitation when the cable is in the passive mode. Because the angular displacement of each cylinder assembly changes as the cylinders extend and retract—the angle between the axis of each assembly and the front wall is greater when the assembly is extended as illustrated in FIG. 2 than it is when the assembly is retracted as illustrated in FIG. 3—the maximum amount of slack in the cable occurs when then cylinders are fully extended as illustrated in FIG. 2, while the least amount of slack occurs when the cylinders are in the retracted position illustrated in FIG. 3.

The construction illustrated in FIGS. 2 through 5 is such that if the connection fails the loose or free end of that cylinder remains between the lateral sides of the compaction panel, and in fact the end of the cylinder does not even exit the respective receiving pocket 70, 72 in the panel. Thus, if the cylinders are thereafter extended, the end of the cylinder 46, 48 will engage and act against the panel so that the forces on both sides of the panel will remain substantially balanced and the panel will not become off-set relative to the rails and, thus will not lock-up. Of course, if the cylinders are retracted the cable will pull the panel at the disconnected end.

Figure 6:
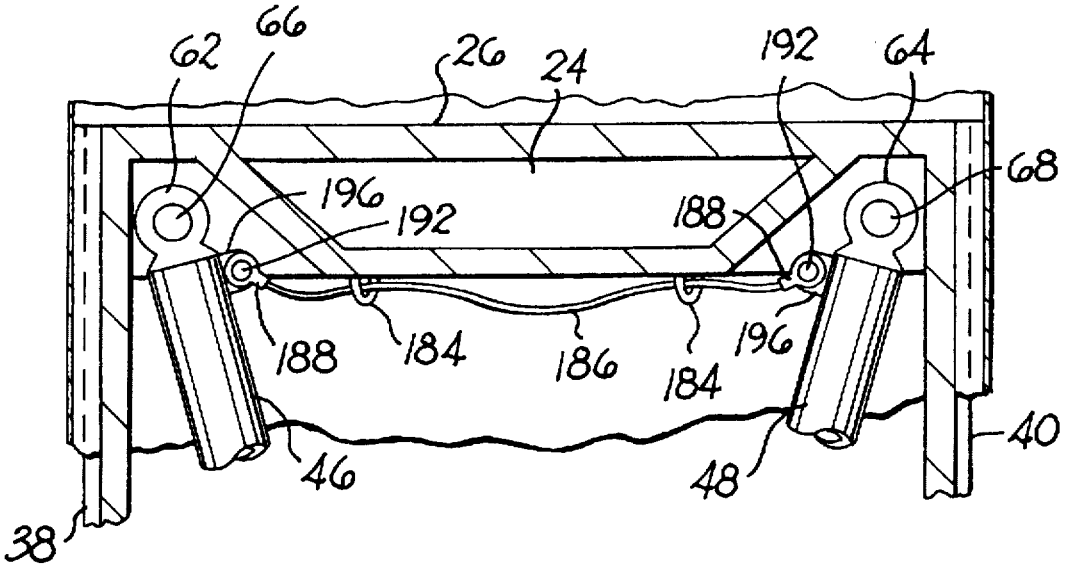
FIG. 6 is fragmentary horizontal cross sectional view through the body showing a second embodiment of the invention.

FIG. 6 illustrates a second embodiment of the invention wherein the first stage cylinders 46, 48 are tied together adjacent the ends that are normally connected to the compaction panel 24. Thus, a lug 196 may be welded to each cylinder adjacent the end and a cable 186 in the form of a wire rope such as that in the first embodiment is provided with a clevis 188 at each end. A pair of panel anchors, which may be in the form of a respective U-bolt or the like 184 secured at the free ends to the compaction panel as by welding is disposed laterally between the panel ends of the cylinders 46, 48. The cable is threaded through the openings in the anchors and the devises are pivotably connected to the respective lugs by a respective pin 192. If a connection between the cylinders 50, 52 and the panel fails, the restraining cable construction will keep the cylinder within the confines of the panel 24. The distance from the anchor 184 to the respective pin 192 should be small enough so that a radius of movement of a cylinder with a failed connection will be such that the end of the cylinder will remain laterally within the compaction panel sides and thus not break through the side of the body 14. A loose cylinder may then push against the panel when the cylinder assemblies are extended. When retracted, the loose cylinder will remain within the panel frame.

Figure 7:
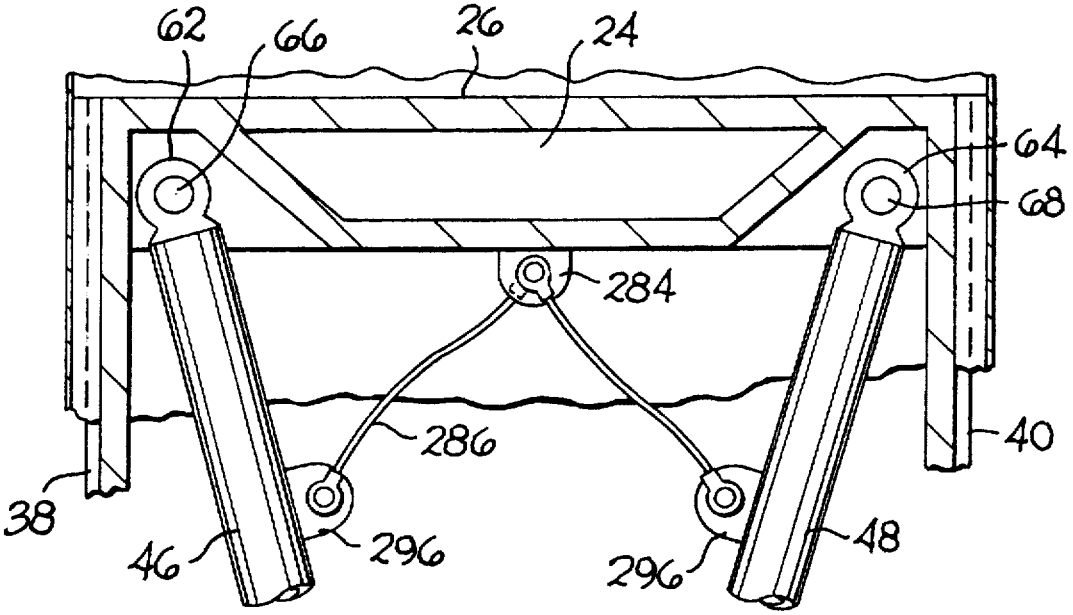
FIG. 7 is a view similar to FIG. 6 but illustrating a third embodiment of the invention.

FIG. 7 illustrates a third embodiment similar to the first two, but here the first stage cylinders 46, 48 are anchored to the panel at a single location in a central portion of the panel. Thus, two cables 286, one pivotally connected at one end to each cylinder 46, 48 at a lug 296 welded to the respective cylinder, is pivotally connected at the other end to an anchor 284 located intermediate the lateral sides of the panel 24. Should the connection between one of the cylinders and the panel fail, the loose cylinder will be restrained by the respective cable.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. A front loading refuse collection vehicle comprising a longitudinally elongated body having a pair of sidewalls extending between front and rear ends for receiving refuse, a compaction panel within said body extending transversely across said body, rail means for guiding said panel for movement longitudinally within said body between a refuse receiving retracted position adjacent the front of the body and refuse compaction extended positions rearwardly of said receiving position, power drive means for forcibly moving said panel between said retracted position and said extended positions selectively, said power drive means comprising at least one hydraulic cylinder assembly having a first end pivotally fastened to a front portion of said body and a second end extendible and retractable relative to said first end pivotally fastened to said panel for moving said panel relative to said body, and restraining means anchored to said panel and connected to said cylinder assembly adjacent said second end of said cylinder assembly for restricting movement of said second end of said cylinder assembly to positions adjacent to said panel and intermediate said side walls only should said second end of said cylinder assembly become unfastened from said panel, said restraining apparatus being passive until said second end becomes unfastened.

2. A front loading refuse collection vehicle as recited in claim 1, wherein said power drive means comprises two hydraulic cylinder assemblies, one of said assemblies having one end pivotally fastened to said body adjacent a first of said side walls and pivotally connected at the second end to said panel adjacent the second of said side walls, and the other of said assemblies having one end pivotally fastened to said body adjacent said second of said side walls and pivotally fastened at the second end to said panel adjacent the first of said side walls, such that one of said assemblies crosses over and above the other of said assemblies, said restraining means comprising restraining apparatus anchored to said panel and connected to each of said cylinder assemblies adjacent respective second ends.

3. A front loading refuse collection vehicle as recited in claim 2, wherein said restraining apparatus comprises first and second restraining members, each of said restraining members having two ends, means for connecting one end of each restraining member to said panel and means for connecting the other end of each restraining member to a respective one of said cylinder assemblies.

4. A front loading refuse collection vehicle as recited in claim 3, wherein said restraining means includes a cable.

5. A front loading refuse collection vehicle as recited in claim 4, wherein said cable comprises a flexible metal wire rope.

6. A front loading refuse collection vehicle as recited in claim 2, wherein said restraining apparatus includes a cable having two ends, means for pivotally connecting one end of said cable to one of said cylinder assemblies and means for connecting the other end of said cable to the other of said cylinder assemblies, and means for anchoring said cable to said panel intermediate said second ends of said cylinder assemblies.

7. A front loading refuse collection vehicle as recited in claim 6, wherein said cable comprises a flexible metal wire rope.

8. A front loading refuse collection vehicle as recited in claim 2, wherein each cylinder assembly comprises a plurality of cylinders of different diameters telescopically disposed relative to each other, the cylinder with the largest diameter having said second end and the cylinder with the smallest diameter having said first end.

9. A front loading refuse collection vehicle as recited in claim 8, wherein said restraining means includes a cable.

10. A front loading refuse collection vehicle as recited in claim 9, wherein said cable comprises a flexible metal wire rope.

11. A front loading refuse collection vehicle as recited in claim 1, wherein said restraining means includes a cable.

12. A front loading refuse collection vehicle as recited in claim 11, wherein said cable comprises a flexible metal wire rope.

13. A front loading refuse collection vehicle as recited in claim 1, wherein said restraining means has two ends, means for connecting one end of said restraining means to said panel and means for connecting the other end of said restraining means to said cylinder assembly.

14. A front loading refuse collection vehicle as recited in claim 13, wherein said restraining means includes a cable.

15. A front loading refuse collection vehicle as recited in claim 14, wherein said cable comprises a flexible metal wire rope.

16. In a front loading refuse collection vehicle comprising a longitudinally elongated body having a pair of side walls extending between front and rear ends for receiving refuse, a compaction panel extending transversely within said body, means for guiding said panel for movement longitudinally intermediate said ends between a refuse receiving position adjacent said front end and refuse compaction positions, and at least one hydraulic cylinder assembly having a first end connected to said body adjacent said front end and a second end connected to said panel, restraining means for restricting movement of said second end of said assembly to positions adjacent said panel and intermediate said side walls of said body if said second end of said cylinder assembly becomes disconnected from said panel, said restraining means being passive unless said second end of said cylinder becomes disconnected from said panel.

17. In a front loading refuse collection vehicle as recited in claim 16, wherein there are two hydraulic cylinder assemblies, each assembly having one end connected to said body and a second end connected to said panel, said restraining means being active to restrict movement of a second end of a cylinder assembly which has been disconnected from said panel.

18. In a front loading refuse collection vehicle as recited in claim 17, wherein said restraining means includes a cable.

19. In a front loading refuse collection vehicle as recited in claim 18, wherein said cable comprises a flexible metal wire rope.

20. In a front loading refuse collection vehicle as recited in claim 17, wherein said restraining means comprises first and second flexible metal ropes, means for connecting one end of each rope to said panel, and means for connecting the other end of each rope to a respective one of said cylinder assemblies adjacent the second end.

21. In a front loading refuse collection vehicle as recited in claim 17, wherein said restraining means includes a flexible metal rope having two ends, means for pivotally connecting one end of said rope to the second end of one of said cylinder assemblies and means for connecting the other end of said rope to the other of said cylinder assemblies, and means for attaching said rope intermediate said second ends to said panel while permitting said rope limited movement relatively to said panel.

* * * * *